US010036980B2

(12) United States Patent
Igarashi et al.

(10) Patent No.: US 10,036,980 B2
(45) Date of Patent: Jul. 31, 2018

(54) DEVELOPING DEVICE AND IMAGE FORMING APPARATUS

(71) Applicant: FUJI XEROX CO., LTD., Tokyo (JP)

(72) Inventors: Tatsuhiro Igarashi, Kanagawa (JP); Manabu Furuki, Kanagawa (JP); Masahiro Uchida, Kanagawa (JP); Makoto Kamisaki, Kanagawa (JP); Teppei Yawada, Kanagawa (JP); Jun Sekiya, Kanagawa (JP); Koji Funaba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/350,670

(22) Filed: Nov. 14, 2016

(65) Prior Publication Data

US 2017/0357176 A1 Dec. 14, 2017

(30) Foreign Application Priority Data

Jun. 14, 2016 (JP) ..... 2016-117645

(51) Int. Cl.
*G03G 15/08* (2006.01)

(52) U.S. Cl.
CPC ..... *G03G 15/0865* (2013.01)

(58) Field of Classification Search
CPC ..... G03G 15/0891; G03G 15/0887; G03G 15/0893; G03G 15/0865
See application file for complete search history.

(56) References Cited

U.S. PATENT DOCUMENTS

2006/0140679 A1 6/2006 Iwata et al.
2015/0003876 A1* 1/2015 Iida ..... G03G 15/0891 399/254

FOREIGN PATENT DOCUMENTS

JP 2006-163292 A 6/2006
JP 2010-145618 A 7/2010

* cited by examiner

*Primary Examiner* — Sandra Brase
(74) *Attorney, Agent, or Firm* — Oliff PLC

(57) ABSTRACT

A developing device includes a container that contains a developer containing a toner therein, a supply tank that is provided adjacent to the container and is supplied with the toner at a supply point within the supply tank, a transport member that is rotatably driven within the supply tank to transport the toner to the container, and an annular member, wherein the annular member has an inner diameter larger than a diameter of a rotatably-driven shaft in the transport member, the rotatably-driven shaft extends through the annular member, and the annular member is held in a partial section in a longitudinal direction of the rotatably-driven shaft.

10 Claims, 4 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2016-117645 filed Jun. 14, 2016.

BACKGROUND

Technical Field

The present invention relates to a developing device and an image forming apparatus.

SUMMARY

According to an aspect of the invention, a developing device includes a container that contains a developer containing a toner therein, a supply tank that is provided adjacent to the container and is supplied with the toner at a supply point within the supply tank, a transport member that is rotatably driven within the supply tank to transport the toner to the container, and an annular member, wherein the annular member has an inner diameter larger than a diameter of a rotatably-driven shaft in the transport member, the rotatably-driven shaft extends through the annular member, and the annular member is held in a partial section in a longitudinal direction of the rotatably-driven shaft.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the accompanying drawings.

Figure 1:
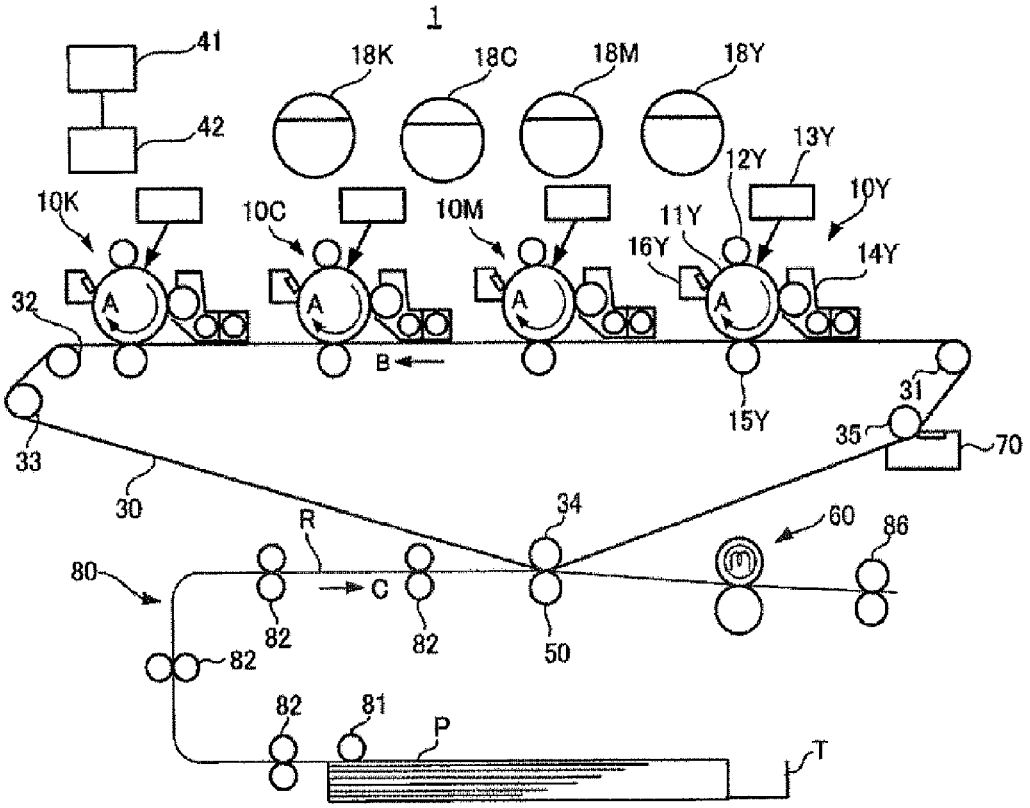
FIG. 1 is a diagram illustrating an image forming apparatus according to an exemplary embodiment of the present invention.

FIG. 1 is a diagram illustrating an image forming apparatus according to an exemplary embodiment of the present invention.

An image forming apparatus 1 illustrated in FIG. 1 is a tandem-type color printer including image engines 10Y, 10M, 10C, and 10K arranged in tandem to correspond to respective colors of yellow (Y), magenta (M), cyan (C) and black (K), and form toner images of the respective colors in parallel. The color printer has an ability of printing a full-color image by superimposing the four color toner images as well as an ability of printing a monochromatic image.

The image forming apparatus 1 is provided with toner cartridges 18Y, 18M, 18C, and 18K which contains toners of Y, M, C, K colors, respectively. The toner corresponds to an example of a colorant referred to in the present invention.

In addition, the image forming apparatus 1 is also provided with a controller 41 configured to control an intermediate transfer belt 30, a fixing device 60, a sheet transport unit 80, and respective units of the image forming apparatus 1. Further, the image forming apparatus 1 is also provided with an environment sensor 42 configured to detect a temperature/humidity environment inside the image forming apparatus 1.

The four image engines 10Y, 10M, 10C, and 10K have the same configuration except for a used developer. Thus, an image engine 10Y corresponding to yellow will be described as an example on behalf of the image engines. The image engine 10Y includes a photoconductor 11Y, a charging unit 12Y, an exposure unit 13Y, a developing device 14Y, a primary transfer unit 15Y, and a photoconductor cleaner 16Y. Among these elements, the elements other than the exposure unit 13Y and the primary transfer unit 15Y are integrated in a so-called process cartridge, and the respective process cartridges have a common structure.

The photoconductor 11Y has a layer of a photosensitive material on the cylindrical surface, and rotates in an arrow A direction around the axis of a cylinder while holding an image formed on the surface thereof. The charging unit 12Y, the exposure unit 13Y, the developing device 14Y, the primary transfer unit 15Y, and the photoconductor cleaner 16Y are sequentially disposed around the photoconductor 11Y. The photoconductor 11Y corresponds to an example of an image carrier referred to in the present invention, and a combination of the charging unit 12Y and the exposure unit 13Y corresponds to an example of a latent image forming device referred to in the present invention. The developing device 14Y corresponds to an exemplary embodiment of a developing device of the present invention.

The charging unit 12Y charges the surface of the photoconductor 11Y by the application of a bias voltage. In the exemplary embodiment, the charging unit 12Y is a charging roll that is in contact with the surface of the photoconductor 11Y. The charging roll is applied with a voltage having the same polarity as a charging polarity of the toner in the developing device 14Y, and charges the surface of the photoconductor 11Y in contact with the charging roll. Meanwhile, besides the charging roll, a corona discharger or the like which is not in contact with the photoconductor 11Y may also be employed as the charging unit 12Y.

The exposure unit 13Y exposes the surface of photoconductor 11Y by irradiating the photoconductor 11Y with laser light according to an image signal of a corresponding color (here, yellow). The image signal is generated by the controller 41 from the image data supplied from the outside of the image forming apparatus 1. An electrostatic latent image is formed on the surface of the photoconductor 11Y due to exposure by the exposure unit 13Y. Meanwhile, besides a system using the laser light, an LED array in which plural LEDs are arranged along a scanning direction may also be employed as the exposure unit 13Y.

The developing device 14Y develops the electrostatic latent image on the surface of the photoconductor 11Y using a so-called two-component developer containing a toner and a magnetic carrier so as to form a toner image. To the developing device 14Y, the toner is supplied from the toner cartridge 18Y. As described in detail below, the developing device 14Y is a trickle-type developing device in which a part of the developer within the device is discharged little by little, and a magnetic carrier is refreshed. A small amount of the magnetic carrier is also supplied from the toner cartridge 18Y together with the toner. The developing device 14Y charges the toner by agitating the developer within the device. Meanwhile, a so-called external additive may be added to the toner in order to enhance a fluidity and a charging property of the toner.

The primary transfer unit 15Y is opposite to the photoconductor 11Y across the intermediate transfer belt 30, and is applied with a voltage of an opposite polarity to the charging polarity of the toner, so that the toner image on the photoconductor 11Y is electrostatically attracted to the intermediate transfer belt 30.

The photoconductor cleaner 16Y scrapes off a residual toner, an external additive, a paper dust, or the like on the surface of the photoconductor 11Y by a cleaning blade that is in contact with the surface of the photoconductor 11Y, thereby cleaning the surface of the photoconductor 11Y after the transfer.

The intermediate transfer belt 30 is an endless belt, is wound on belt support rolls 31 to 35, and circularly moves in a direction indicated by the arrow B via the image engines 10Y, 10M, 10C, and 10K, and a secondary transfer unit 50. Toner images of respective colors are transferred from the image engines 10Y, 10M, 10C, and 10K to the intermediate transfer belt 30 to overlap each other, and thus, a color toner image is formed. The intermediate transfer belt 30 circularly moves in the direction indicated by the arrow B while holding the toner image, and then sends the toner images to the secondary transfer unit 50.

Meanwhile, the sheet transport unit 80 takes out a sheet of paper P accommodated in a supply sheet tray T by a pickup roll 81, and transports the sheet of paper P by transport rolls 82 to the secondary transfer unit 50 along a sheet transport path R in the arrow C direction.

The secondary transfer unit 50 is a roll that rotates with the intermediate transfer belt 30 and the sheet of paper being interposed between a backup roll 34 that is one of the belt support rolls 31 to 35 and the secondary transfer unit 50. The secondary transfer unit 50 is applied with a voltage of an opposite polarity to the charging polarity of the toner so that the toner image on the intermediate transfer belt 30 is electrostatically attracted to the sheet of paper, thereby forming an unfixed toner image on the paper.

The belt cleaner 70 scrapes off the toner, the external additive, the paper dust, or the like on the intermediate transfer belt 30 by putting a blade into contact with the intermediate transfer belt 30 which has passed through the secondary transfer unit 50.

The fixing device 60 fixes the unfixed toner image on the sheet of paper by heat and pressure.

The sheet of paper on which the toner image is fixed is discharged to the outside of the apparatus by a discharge roll 86 that is a part of the sheet transport unit 80.

Here, the developing device will be further described. Meanwhile, in the following description, it is noted that in some numerals including letters "Y," "M," "C," and "K" indicating colors among the numerals illustrated in FIG. 1, the letters are omitted.

Figure 2:
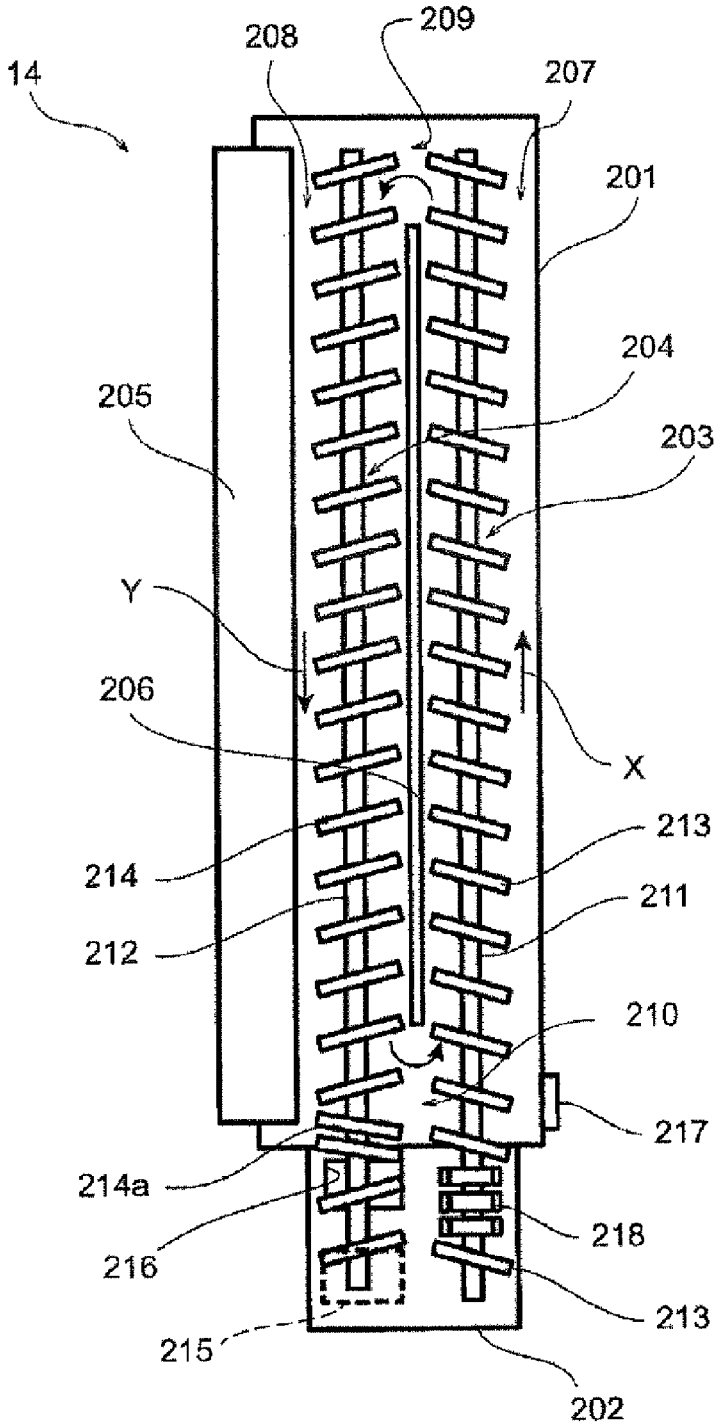
FIG. 2 is a transparent view illustrating an interior of a developing device illustrated in FIG. 1 when viewed from above.

FIG. 2 is a transparent view illustrating an interior of a developing device illustrated in FIG. 1 when viewed from above.

The developing device 14 includes a developer container 201 within which a developer is contained, a toner supply tank 202 adjacent to the developer container 201, two transport members 203 and 204 extending parallel to each other, and a developing roll 205 extending parallel to the transport members 203 and 204 and rotating in a direction perpendicular to the transport members 203 and 204. The developer container 201 is an example of a container referred to in the present invention, and the toner supply tank 202 is an example of a supply tank referred to in the present invention.

The developing roll 205 has a magnet therein, and rotates while adsorbing the developer on the surface thereof by a magnetic force so as to send the developer from the developer container 201 to a developing position facing the photoconductor 11. At the developing position, a latent image is developed, and the developer after the development is returned to the developer container 201 by rotation of the developing roll 205.

A partition wall 206 is provided between the two transport members 203 and 204 within the developer container 201, and the developer container 201 is partitioned into two chambers 207 and 208. Openings 209 and 210 are formed at both ends portion of the partition wall 206 in the longitudinal direction, respectively.

The two transport members 203 and 204 include round bar-shaped rotary shafts 211 and 212, and spiral blades 213 and 214, respectively. The spiral blades 213 and 214 are provided around the rotary shafts 211 and 212, and extend in a spiral form in the extension direction of the rotary shafts 211 and 212. The transport members 203 and 204 rotate such that the first transport member 203 transports the developer within the first chamber 207 in the arrow X direction while agitating the developer, and the second transport member 204 transports the developer within the second chamber 208 in the arrow Y direction while agitating the developer. The developer transported in the arrow X direction moves to the second chamber 208 through the first opening 209, and the developer transported in the arrow Y direction moves to the first chamber 207 through the second opening 210. Accordingly, the developer within the developer container 201 circularly moves while being agitated by the two transport members 203 and 204. Due to such agitation of the developer, the toner is charged in the developer as described above.

The transport members 203 and 204 extend to the inside of the toner supply tank 202 adjacent to the developer container 201, but a circular movement of the developer does not pass through the toner supply tank 202.

A reception port 215 configured to receive a toner supplied from the toner cartridge 18 is formed on a top surface portion that is located at a distance from the developer container 201 within the toner supply tank 202. The toner received in the developing device 14 through the reception port 215 is moved to the first chamber 207 of the developer container 201 by being transported by the transport members 203 and 204, and mixed with the developer. A portion of the transport members 203 and 204 extending to the inside of the toner supply tank 202 is an example of a transport member referred to in the present invention. The transport member referred to in the present invention may be different from an agitation member that agitates the developer within the developer container 201. If the transport members 203 and 204 are integrated as in the exemplary embodiment, a simple structure is achieved and is thus desirable.

A discharge port 216 is formed on the bottom of the toner supply tank 202 between the reception port 215 and the developer container 201. Reverse spiral blades 214*a* whose spiral direction is reversed with respect to the spiral direction of the spiral blades 214 in another portion are provided between the developer container 201 and the toner supply tank 202. Most of the developer that has been transported through the second chamber 208 of the developer container 201 in the arrow Y direction is thus guided to the second opening 210 by the reverse spiral blades 214*a* and moved to the first chamber 207, while a part of the developer enters into the toner supply tank 202 by climbing over the reverse spiral blades 214*a*. The developer entering into the toner supply tank 202 is discharged from the discharge port 216 to the outside of the developing device 14.

A TC sensor 217 configured to measure a ratio of a toner to a carrier (TC) in the developer circulating within the developer container 201 is provided in the developing device 14. The controller 41 instructs the toner cartridge 18 to supply the toner based on the value measured by the TC sensor 217, so that the TC value of the developer is kept constant.

Cylindrical members 218 are held to the rotary shaft 211 of the transport member 203 on the transport path within the toner supply tank 202, through which the toner is transported from the reception port 215 to the developer container 201. An inner diameter of each cylindrical member 218 is sufficiently larger than the rotary shaft 211. Thus, the cylindrical members 218 are loosely fitted to the rotary shaft 211, and bump into or rub against the rotary shaft 211 when the rotary shaft 211 is rotated. The cylindrical members 218 move to some extent in the direction along the rotary shaft 211, but are always held within a holding section where no spiral blade 213 of the transport member 203 is provided. In order to suppress a reduction of the transport capability by the transport member 203, a length of the holding section is preferably within one pitch of the spiral blade 213. The cylindrical member 218 is one example of the annular member referred in the present invention.

The toner concentration within the toner supply tank 202 is higher than that in the developer container 201. Thus, when the cylindrical member 218 is not provided, the toner may adhere to the transport member 203 in a case where a high temperature state, a high humidity state, or an image formation with a high image density continues.

Figure 3:
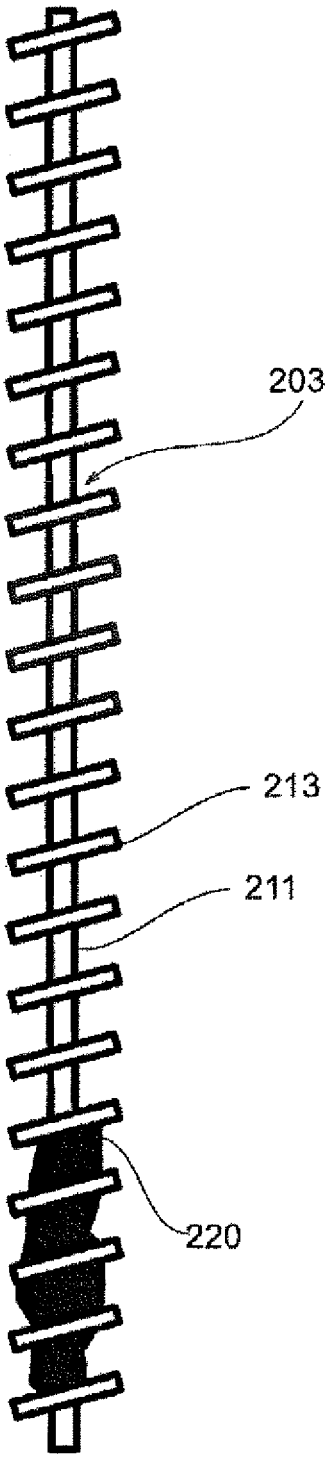
FIG. 3 is a view illustrating a state where a toner adheres to a rotary shaft of a transport member.

FIG. 3 is a view illustrating a state where the toner adheres to the rotary shaft 211 of the transport member 203.

When the above described cylindrical member 218 is not provided, the toner 220 may adhere to the rotary shaft 211 of the transport member 203 and be firmly fixed thereto in a case where a high temperature state, a high humidity state, or an image formation with a high image density continues. When such adhesion of the toner 220 occurs, the transporting force by the transport member 203 is reduced, and as a result, a following toner stays on the transport path, causing a path clogging.

In contrast, when the cylindrical member 218 is provided, the toner 220 is removed from the rotary shaft 211 by the motion of the cylindrical member 218 following the rotation of the rotary shaft 211, and the adhesion of the toner 220 is suppressed. As a result, the reduction of the transporting force is also suppressed. Also, when the plural cylindrical members 218 (three cylindrical members in the exemplary embodiment) are provided within the holding section, the cylindrical members 218 move to collide with each other, and thus, the ability of removing or suppressing adhesion of the toner 220 is increased. Also, when, for example, a transport distance within the toner supply tank 202 is long, plural holding sections of the cylindrical members 218 may be provided. When the plural holding sections are provided, the adhesion of the toner 220 is removed in a wide range.

Figure 4:
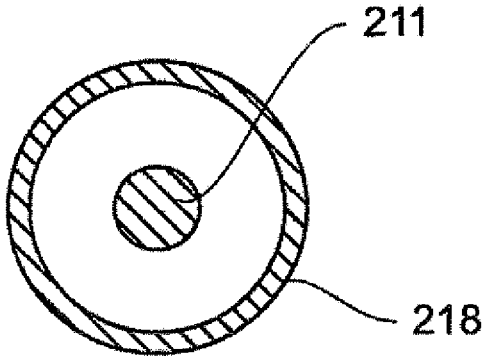
FIG. 4 is a sectional view illustrating a relationship between a cylindrical member and the rotary shaft.

FIG. 4 is a sectional view illustrating a relationship between the cylindrical member 218 and the rotary shaft 211.

As described above, the rotary shaft 211 extends through the cylindrical member 218. Also, in the exemplary embodiment, an outer diameter of the rotary shaft 211 is about 10 mm while the inner diameter of the cylindrical member 218 is about 30 mm, and a thickness of the cylindrical member 218 is about 5 mm.

Since the inner diameter of the cylindrical member 218 is larger than the outer diameter of the rotary shaft 211, the action of removing or suppressing adhesion of the toner 220 occurs. Also, when the inner diameter of the cylindrical member 218 is 1.5 times or more and 10 times or less the outer diameter of the rotary shaft 211, the adhering toner 220 is efficiently collapsed, and thus, the ability of removing or suppressing adhesion is increased.

In the above description, a cylindrical member is exemplified as an annular member referred to in the present invention. The annular member referred to in the present invention is not limited to the cylindrical shape, but may have a polygonal cross-section.

Also, in the above description, a case where no spiral blade 213 is provided in the holding section is described. Alternatively, the annular member referred to in the present invention may be held to the rotary shaft 211 through, for example, a hole formed in the root of the spiral blade 213.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container that contains a developer containing a toner therein;

a supply tank that is provided adjacent to the container and is supplied with the toner at a supply point within the supply tank;

a transport member that is rotatably driven within the supply tank to transport the toner to the container; and an annular member, wherein the annular member has an inner diameter larger than a diameter of a rotatably-driven shaft in the transport member creating separation between the annular member and the rotatably-driven shaft so that the annular member does not rotate in unison with the rotatably-driven shaft, the rotatably-driven shaft extends through the annular member, and the annular member is held in a partial section in a longitudinal direction of the rotatably-driven shaft.

2. The developing device according to claim 1, wherein the transport member has an agitating blade around the rotatably-driven shaft except the section where the annular member is held.

3. The developing device according to claim 1, wherein the developing device comprises a plurality of the annular members.

4. The developing device according to claim 1, wherein the annular member is a cylindrical member.

5. The developing device according to claim 1, wherein the annular member has a polygonal cross-section.

6. The developing device according to claim 1, wherein an inner diameter of the annular member is in a range of from 1.5 times to 10 times as large as an outer diameter of the rotatably-driven shaft in the transport member.

7. An image forming apparatus comprising:

an image carrier;

a latent image forming device that forms a latent image on a surface of the image carrier; and a developing device that contains an electrostatic charge image developer and develops the latent image formed on the surface of the image carrier with the electrostatic charge image developer into a toner image, wherein the developing device includes a container that contains a developer containing a toner therein, a supply tank that is provided adjacent to the container and is supplied with the toner at a supply point within the supply tank, a transport member that is rotatably driven within the supply tank to transport the toner to the container, and an annular member, the annular member has an inner diameter larger than a diameter of a rotatably-driven shaft in the transport member creating separation between the annular member and the rotatably-driven shaft so that the annular member does not rotate in unison with the rotatably-driven shaft, the rotatably-driven shaft extends through the annular member, and the annular member is held in a partial section in a longitudinal direction of the rotatably-driven shaft.

8. The image forming apparatus according to claim 7, wherein an inner diameter of the annular member is in a range of from 1.5 times to 10 times as large as an outer diameter of the rotatably-driven shaft in the transport member.

9. The image forming apparatus according to claim 7, wherein the transport member has an agitating blade around the rotatably-driven shaft except the section where the annular member is held.

10. The image forming apparatus according to claim 7, wherein the developing device comprises a plurality of the annular members.

* * * * *